US009388748B2

(12) United States Patent
Mano

(10) Patent No.: US 9,388,748 B2
(45) Date of Patent: Jul. 12, 2016

(54) CONTROL DEVICE AND CONTROL METHOD FOR INTERNAL COMBUSTION ENGINE

(71) Applicant: NISSAN MOTOR CO., LTD., Yokohama-shi, Kanagawa (JP)

(72) Inventor: Tadaki Mano, Sagamihara (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/764,343

(22) PCT Filed: Jan. 10, 2014

(86) PCT No.: PCT/JP2014/050285
§ 371 (c)(1),
(2) Date: Jul. 29, 2015

(87) PCT Pub. No.: WO2014/125848
PCT Pub. Date: Aug. 21, 2014

(65) Prior Publication Data

US 2015/0361904 A1 Dec. 17, 2015

(30) Foreign Application Priority Data

Feb. 18, 2013 (JP) ..... 2013-028554

(51) Int. Cl.
*F02D 15/04* (2006.01)
*F02D 15/02* (2006.01)
(Continued)

(52) U.S. Cl.
CPC ..... *F02D 15/02* (2013.01); *F02D 41/22* (2013.01); *F02D 41/3836* (2013.01); *F02D 2041/224* (2013.01); *F02D 2041/226* (2013.01); *F02D 2041/227* (2013.01); *F02D 2200/0602* (2013.01)

(58) Field of Classification Search
CPC ..... F02D 15/02; F02D 41/22; F02D 41/3836; F02D 2200/0602; F02D 2041/227; F02D 2041/224; F02D 2041/226
See application file for complete search history.

(56) References Cited

U.S. PATENT DOCUMENTS

2007/0186907 A1* 8/2007 Otani ..... F01L 1/024 123/446
2008/0087255 A1* 4/2008 Aoyama ..... F02D 13/023 123/48 B (Continued)

FOREIGN PATENT DOCUMENTS

JP S63-186925 A 8/1988
JP H10-238391 A 9/1998

(Continued)

OTHER PUBLICATIONS

U.S. Appl. No. 14/768,279, filed Aug. 17, 2015, Mano et al.

(Continued)

*Primary Examiner* — Hung Q Nguyen
(74) *Attorney, Agent, or Firm* — Drinker Biddle & Reath LLP

(57) ABSTRACT

A control device for an internal combustion engine which includes a variable compression ratio mechanism arranged to vary a mechanical compression ratio, and a high pressure fuel pump arranged to supply a high pressure fuel to a common rail, and to be driven from a crank shaft through a chain, the control device includes: a fuel pressure abnormal state sensing section configured to sense an abnormal increase of a fuel pressure within the common rail, the control device being configured to decrease the compression ratio in the abnormal state of the fuel pressure.

4 Claims, 4 Drawing Sheets

(51) Int. Cl.
*F02D 41/22* (2006.01)
*F02D 41/38* (2006.01)

(56) References Cited

U.S. PATENT DOCUMENTS

2009/0107434 A1* 4/2009 Berger ..... F01L 1/047 123/90.31
2010/0268441 A1 10/2010 Yoshiume
2010/0312459 A1* 12/2010 Utsumi ..... F02D 15/02 701/106
2011/0290217 A1* 12/2011 Kimura ..... F02D 15/04 123/48 C
2012/0216776 A1* 8/2012 Nagatsu ..... F02D 13/0234 123/305

FOREIGN PATENT DOCUMENTS

JP H11-13502 A 1/1999
JP 2004-116434 A 4/2004
JP 2010-248997 A 11/2010

OTHER PUBLICATIONS

U.S. Appl. No. 14/774,770, filed Sep. 11, 2015, Mano et al.
U.S. Appl. No. 14/764,359, filed Jul. 29, 2015, Mano.

* cited by examiner

CONTROL DEVICE AND CONTROL METHOD FOR INTERNAL COMBUSTION ENGINE

TECHNICAL FIELD

This invention relates to an internal combustion engine provided with a common rail type fuel injection device which uses a high pressure fuel pump that is driven from a crank shaft through a chain, more specifically to a control device and a control method for an internal combustion engine provided with a variable compression ratio mechanism.

BACKGROUND ART

There is known a common rail fuel injection device arranged to supply a high pressure fuel into a common rail by using a high pressure fuel pump which is mechanically driven by an output of an internal combustion engine, and to open fuel injection valves of cylinders connected to this common rail to inject the fuel, by a driving pulse signal.

For example, a plunger pump which is driven by a cam provided to a cam shaft of an intake valve side or an exhaust valve side is often used as the high pressure fuel pump, like a patent document 1. In a middle of a discharge process in which the plunger is pressed by the cam, a spill valve releases a pump chamber. With this, a substantial discharge amount of the plunger pump, that is, a fuel pressure within the common rail is adjusted.

In a case of a structure in which the cam shaft is driven through a chain by a crank shaft, the high pressure fuel pump is mechanically driven through the chain by the crank shaft.

In the structure in which the high pressure fuel pump is mechanically driven in this way through the chain by the crank shaft, a reaction force according to the pump drive is acted to the chain. Accordingly, when the fuel pressure within the common rail is extraordinarily increased by some abnormal state such as the malfunction of the spill valve, the variation of the tension of the chain and the peak value of the tension becomes excessive. This is not preferable for the durability of the chain, and so on.

Besides, a patent document 2 discloses that the fuel injection is immediately stopped for protecting the engine when the abnormal state of the fuel injection device is sensed. However, it is not preferable that the drive of the internal combustion engine is immediately stopped in a case where the vehicle needs to continue to run.

PRIOR ART DOCUMENT

Patent Document

Patent Document 1: Japanese Patent Application Publication No. 2010-248997

Patent Document 2: Japanese Patent Application Publication No. 10-238391

SUMMARY OF THE INVENTION

Problems which the Invention is Intended to Solve

It is an object of the present invention to protect the chain while making possible the continuation of the drive of the internal combustion engine, in the abnormal state of the fuel pressure within the common rail by the high pressure fuel pump.

In the present invention, a control device for an internal combustion engine which includes a variable compression ratio mechanism arranged to vary a mechanical compression ratio, and a high pressure fuel pump arranged to supply a high pressure fuel to a common rail, and to be driven from a crank shaft through a chain, the control device comprises: a fuel pressure abnormal state sensing means configured to sense an abnormal state of a fuel pressure within the common rail, the control device being configured to decrease the compression ratio in the abnormal state of the fuel pressure.

In the rotation of the crank shaft of the internal combustion engine, there is microscopic rotation variation according to the compression stroke and the expansion stroke of the cylinders. In a case where the high pressure fuel pump and the intake and exhaust valves are driven from the crank shaft through the chain, the tension variation of the chain is caused by the rotation variation of the crank shaft. This tension variation is one of the causes of the reduction of the durability of the chain.

In this case, when the fuel pressure within the common rail is extraordinarily increased, the reaction force according to the drive of the high pressure fuel pump is increased, so that the tension of the chain is increased. In particular, in a case of the plunger pump in which the high pressure fuel pump is intermittently pressed by the cam, the tension variation of the chain by the reaction force which is intermittently acted is superimposed with the tension variation according to the rotation variation. Accordingly, the very large tension variation may be generated.

In the present invention, in the abnormal state of the fuel pressure within the common rail, the mechanical compression ratio is decreased by the variable compression ratio mechanism. By this decrease of the compression ratio, the rotation variation of the crank shaft according to the compression stroke and the expansion stroke of the cylinders become small. The tension variation and the tension peak value of the entire chain which are obtained by adding the reaction force of the high pressure fuel pump is suppressed.

By the present invention, when the fuel pressure is extraordinarily increased due to the some abnormal state, it is possible to protect the chain by decreasing the compression ratio by the variable compression ratio mechanism. Moreover, it is possible to continue the drive of the internal combustion engine although there is generated a few disadvantage such as the reduction of the thermal efficiency.

DESCRIPTION OF EMBODIMENTS

Hereinafter, one embodiment according to the present invention is illustrated in detail based on drawings.

Figure 1:
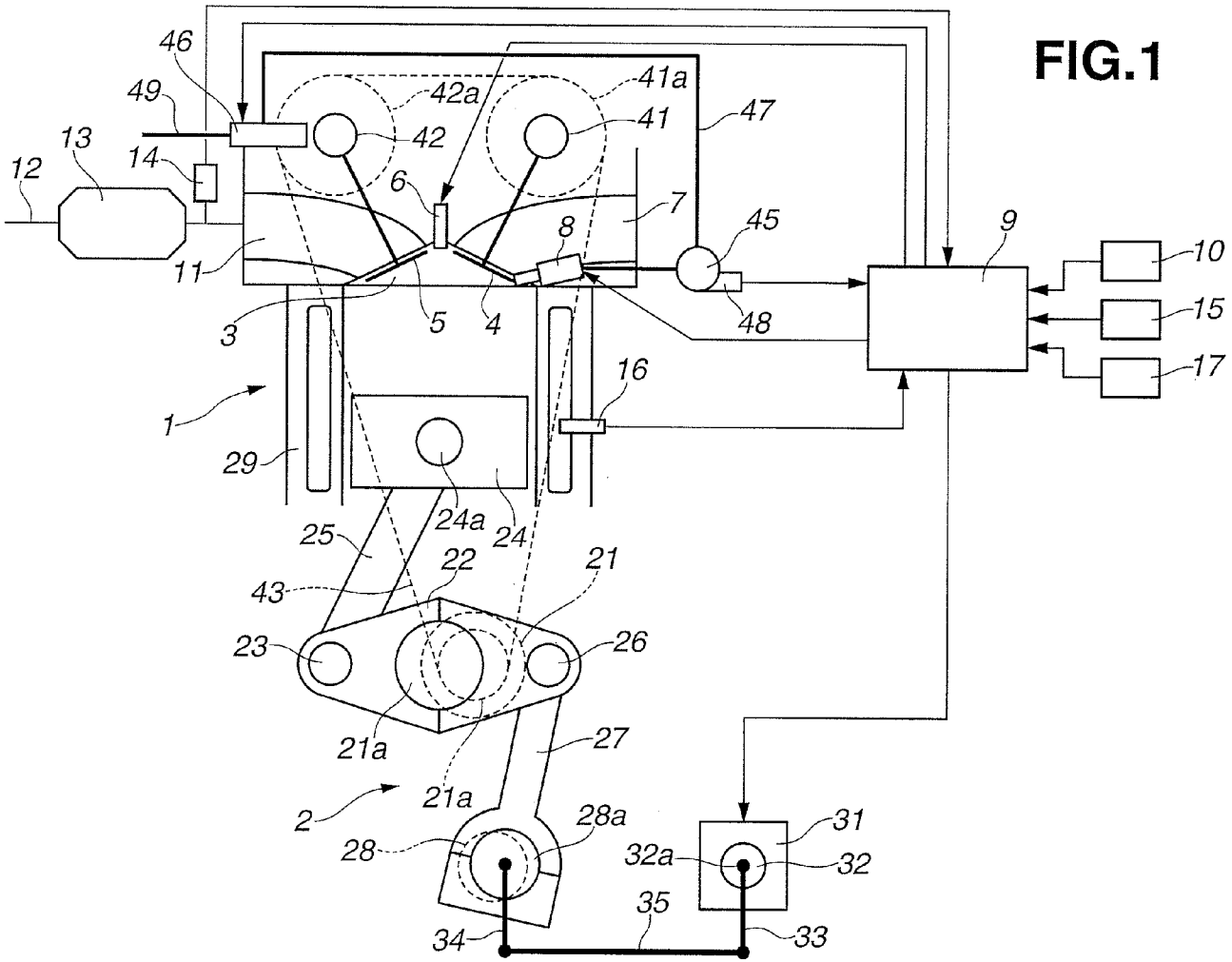
FIG. 1 is a structure explanation view showing a system structure of a control device for an internal combustion engine according to one embodiment of the present invention.

FIG. 1 shows a system structure of an internal combustion engine 1 for a vehicle (automobile) to which the present invention is applied. This internal combustion engine 1 is a spark ignition internal combustion engine which is a fourstroke-cycle cylinder direct injection type, and which is provided with a variable compression ratio mechanism 2 arranged to use, for example, a multi-link piston crank mechanism. In this internal combustion engine 1, a pair of intake valves 4 and a pair of exhaust valves 5 are disposed on a wall surface of a ceiling (upper portion) of a combustion chamber 3. An ignition plug 6 is disposed at a central portion which is surrounded by these intake valves 4 and exhaust valves 5.

The intake valves 4 and the exhaust valves 5 serve as DOHC type valve actuating mechanism arranged to be driven to be opened and closed by an intake cam shaft 41 and an exhaust cam shaft 42 which are disposed at an upper portion of the cylinder head. Then, these cam shafts 41 and 42 are driven through a chain 43 by a crank shaft 21. The chain 43 is wound around a crank shaft sprocket 21*a* provided at a front end of the crank shaft 21, and cam shaft sprockets 41*a* and 42*a* provided at front ends of the cam shafts 41 and 42. The numbers of the teeth are set so that the crank shaft 21 rotates one revolution at each 360 degrees CA, and so that the cam shaft 41 and 42 rotate one revolution at each 720 degrees CA.

Besides, a VTC mechanism may be provided between the cam shaft sprockets 41*a* and 42*a* and the cam shafts 41 and 42. The VTC mechanism is arranged to vary a phase relation between the cam shaft sprockets 41*a* and 42*a* and the cam shafts 41 and 42, within a predetermined angle, and thereby to advance and retard the valve opening timing and the valve closing timing. Moreover, in the example shown in the drawings, the chain 43 is wound around the crank shaft 21 and the cam shafts 41 and 42. Accordingly, this system has one stage type chain driving mechanism. However, it is optional to employ a two stage type chain driving mechanism, that is, to interlock the crank shaft 21 and the cam shafts 41 and 42 by two chains through an intermediate sprocket.

A fuel injection valve 8 is disposed below an intake port 7 which is opened or closed by the intake valve 4. The fuel injection valve 8 is arranged to directly inject the fuel within the combustion chamber 3. An electrically controlled throttle valve (not shown) is disposed in an intake passage (not shown) connected to the intake port 7. An opening degree of the electrically controlled throttle valve is controlled by a control signal from the engine controller 9. Moreover, there is an air flow meter 10 which is disposed on an upstream side of the electrically controlled throttle valve, and which is arranged to sense an intake air quantity.

The fuel injection valve 8 is an electromagnetic injection valve or a piezoelectric injection valve which is arranged to be opened by being applied with a driving pulse signal. The fuel injection valve 8 is arranged to inject the fuel having an amount which is substantially proportional to a pulse width of the driving pulse signal. The fuel injection valve 8 of each cylinder is connected to a common rail 45 serving also as a pressure accumulation chamber. This common rail 45 is supplied with a high pressure fuel pressurized by the high pressure fuel pump 46 through a high pressure fuel piping 47. The fuel pressure within the common rail 45 is sensed by a fuel pressure sensor 48.

The high pressure fuel pump 46 is a plunger pump which is a mechanically driven type, and which is arranged to pressurize the fuel introduced by a feed pump (not shown) through a low pressure fuel piping 49, by a reciprocating linear motion of a plunger (not shown). In the high pressure fuel pump 46, a pump driving cam (not shown) integrally provided with the exhaust cam shaft 42 presses the plunger. For example, the pump driving cams are provided to the exhaust cam shaft 42 at each 90 degrees. With this, the plunger is pressed at each 180 degrees CA. Moreover, the high pressure fuel pump 46 is installed with a spill valve (not shown) arranged to release the pump chamber in a middle of the discharge process by the plunger, based on a control signal from the engine controller 9. The high pressure fuel pump 46 is arranged to vary the discharge amount to the common rail 45 through this spill valve, and thereby to variably control the fuel pressure within the common rail 45 to a desired fuel pressure.

Besides, a fuel pressure control valve may be provided to the common rail 45's side. With this, it is optional to variably control the fuel pressure by returning a part of the high pressure fuel within the common rail 45 to a low pressure side.

Moreover, in the exhaust passage 12 connected to the exhaust port 11, there is disposed a catalyst device 13 which is a three-way catalyst. On an upstream side of the catalyst device 13, there is disposed an air fuel ratio sensor 14 arranged to sense an air fuel ratio.

The engine controller 9 is configured to receive the detection signals from the air flow meter 10, the air fuel ratio sensor 14, and the fuel pressure sensor 48, and further a detection signal from a crank angle sensor. 15 arranged to sense an engine rotation speed, a detection signal from a water temperature sensor 16 arranged to sense a coolant temperature, a detection signal from an accelerator opening degree sensor 17 arranged to sense a depression amount of the accelerator pedal which is operated by the driver, and so on. The engine controller 9 is configured to appropriately control a fuel injection amount and an injection timing by the fuel injection valve 8, an ignition timing by the ignition plug 6, an opening degree of a throttle valve (not shown), a fuel pressure within the common rail 45, based on these detection signals.

On the other hand, the variable compression ratio mechanism 2 uses a known multi-link piston crank mechanism which is described in Japanese Patent Application Publication No. 2004-116434. The variable compression ratio mechanism 2 mainly includes a lower link 22 rotatably supported by a crank pin 21*a* of the crank shaft 22; an upper link 25 connecting an upper pin 23 provided to one end portion of this lower link 22, and a piston pin 24*a* of the piston 24; a control link 27 having one end connected to a control pin 26 provided to the other end portion of the lower link 22; and a control shaft 28 swingably supporting the other end of the control link 27. The crank shaft 21 and the control shaft 28 are rotatably supported through a bearing configuration (not shown) within a crank case provided at a lower portion of the cylinder block 29. The control shaft 28 includes an eccentric shaft portion 28*a* arranged to vary a position in accordance with the rotation of the control shaft 28. The end portion of the control link 27 is rotatably mounted on this eccentric shaft portion 28*a*. In this variable compression ratio mechanism 24, a top dead center (upper dead center) of the piston 24 is displaced in the upward direction and in the downward direction in accordance with the pivot movement of the control shaft 28. With this, the mechanical compression ratio is varied.

Moreover, there is provided an electric motor 31 which serves as a driving mechanism arranged to variably control a compression ratio of the variable compression ratio mechanism 2, which has a rotation center shaft (axis) parallel with the crank shaft 21, and which is disposed at a lower portion of the cylinder block 29. A speed reduction device 32 is connected to be arranged in series with this electric motor 31 in the axial direction. This speed reduction device 32 is, for example, a wave gear mechanism having a large speed reduction ratio. A speed reduction device output shaft 32*a* of the speed reduction device 32 is positioned coaxially with an output shaft (not shown) of the electric motor 31. Accordingly, the speed reduction device output shaft 32*a* and the control shaft 28 are disposed parallel to each other. A first arm 33 fixed to the speed reduction device output shaft 32*a* and a second arm 34 fixed to the control shaft 28 are connected with each other by an intermediate link 35 so that the speed reduction output shaft 32*a* and the control shaft 28 are pivoted in conjunction with each other.

That is, when the electric motor 31 is rotated, an angle of the speed reduction device output shaft 32*a* is varied so as to largely decrease the speed by the speed reduction device 32. This pivot movement of the speed reduction device output shaft 32*a* is transmitted from the first arm 33 through the intermediate link 35 to the second arm 34, so that the control shaft 28 is pivoted. With this, as described above, the mechanical compression ratio of the internal combustion engine 1 is varied. Besides, in the example shown in the drawings, the first arm 33 and the second arm 34 extend in the same direction. Accordingly, for example, when the speed reduction device output shaft 32*a* is pivoted in the clockwise direction, the control shaft 28 is also pivoted in the clockwise direction. However, it is possible to constitute a link mechanism so that the speed reduction device output shaft 32*a* and the control shaft 28 are pivoted in the opposite directions.

The target compression ratio of the variable compression ratio mechanism 2 is set in the engine controller 9 based on the engine driving condition (for example, desired load and the engine speed). The electric motor 31 is drivingly controlled to attain this target compression ratio.

Figure 2:
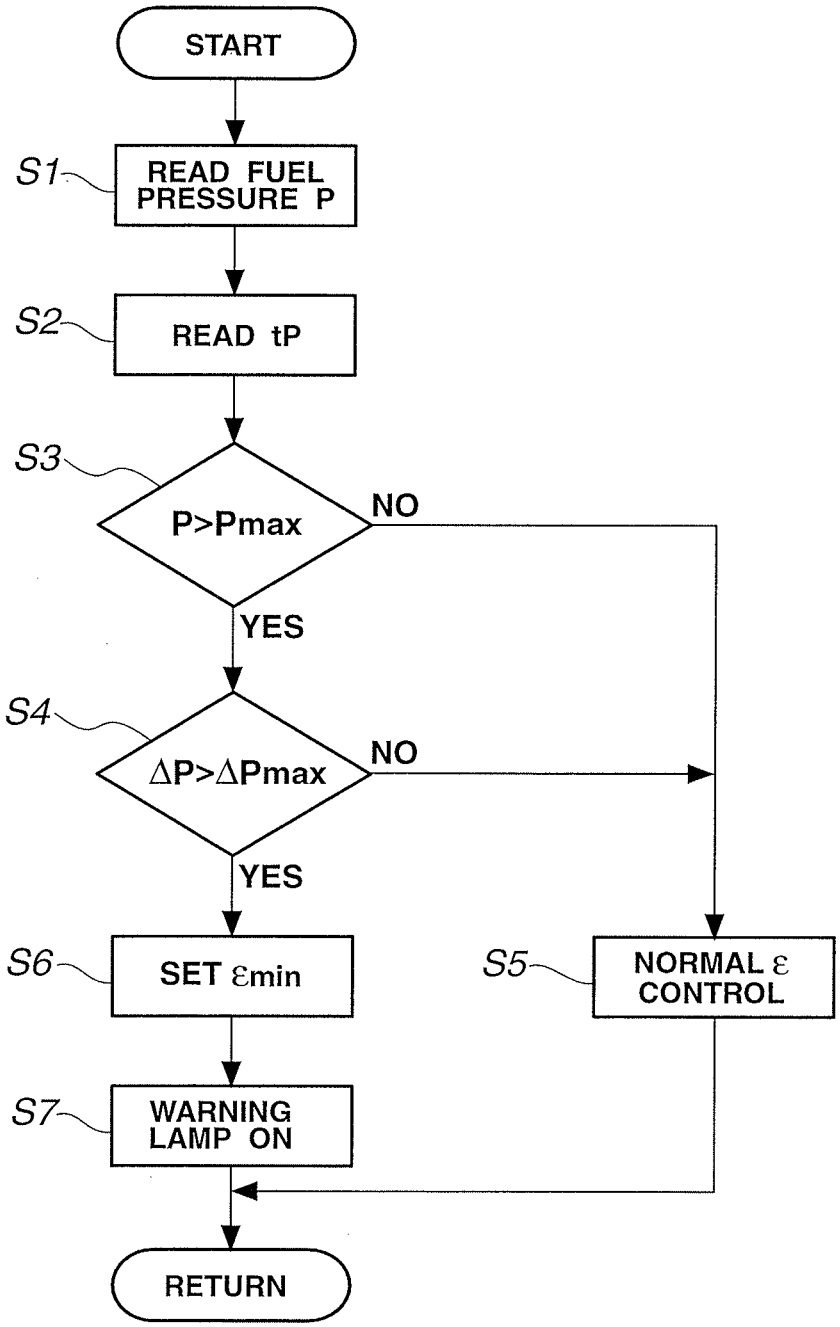
FIG. 2 is a flowchart showing a flow of a control in this embodiment.

FIG. 2 is a flowchart showing a flow of the control of this embodiment which is repeated in the engine controller 9 during the drive of the internal combustion engine 1. This is a routine for monitoring the abnormal state of the fuel pressure, and for protecting the chain 43 in the abnormal state of the fuel pressure. At step 1, the actual fuel pressure P at that time is read by the fuel pressure sensor 48. At step 2, the target fuel pressure tP set in accordance with the engine driving condition at that time is read. Besides, the spill valve of the above-described high pressure fuel pump 46 is controlled by another fuel pressure control routine (not shown) so that the fuel pressure P corresponds to the target fuel pressure tP.

At step 3, it is judged whether or not the fuel pressure P exceeds a predetermined upper limit fuel pressure Pmax. In this case, when the fuel pressure P is equal to or smaller than the upper limit fuel pressure Pmax, the process proceeds to step 5 since the fuel pressure control is performed in the normal state. The normal compression ratio control is performed. That is, a basic target compression ratio according to the engine driving condition is used as the target compression ratio of the variable compression ratio mechanism 2.

When the fuel pressure P exceeds the upper limit fuel pressure Pmax, the process proceeds to step 4. It is judged whether or not a difference ΔP obtained by subtracting the target fuel pressure tP from the fuel pressure P at that time exceeds a predetermined threshold value ΔPmax. The above-described threshold value ΔPmax is set in consideration of the deviation which may be generated in the normal state by the response delay of the fuel pressure control and the pressure pulsation within the common rail 45. When the difference ΔP is equal to or smaller than the threshold value ΔPmax at step 4, the fuel pressure control is performed in the normal state. The process proceeds to step 5. The normal compression ratio control is performed.

On the other hand, when the deviation ΔP exceeds ΔPmax at step 4, it is judged that the fuel pressure control is not performed in the normal state, and that the fuel pressure P is extraordinarily increased. The process proceeds to step 6. The target compression ratio of the variable compression ratio mechanism 2 is set to a minimum compression ratio εmin. This minimum compression ratio εmin is a minimum compression ratio which is controllable in the variable compression ratio mechanism 2. Then, at step 7, a warning light to inform that the fuel pressure control is in the abnormal state is lightened. Besides, the decrease of the thermal efficiency and so on is generated when the compression ratio becomes lower than the appropriate basic target pressure compression ratio. The drive itself of the internal combustion engine 1 is not in particular limited even in the fuel pressure abnormal state. The drive of the internal combustion engine 1 is continued. A pulse width of the driving pulse of the fuel injection valve 8 is set based on the desired (necessary) fuel injection amount and the actual fuel pressure P. Accordingly, the air fuel ratio control is not affected) in particular.

When the fuel pressure P is increased in this way in the abnormal state, the mechanical compression ratio is decreased through the variable compression ratio mechanism 2. With this, it is possible to protect the chain 43.

Figure 3:
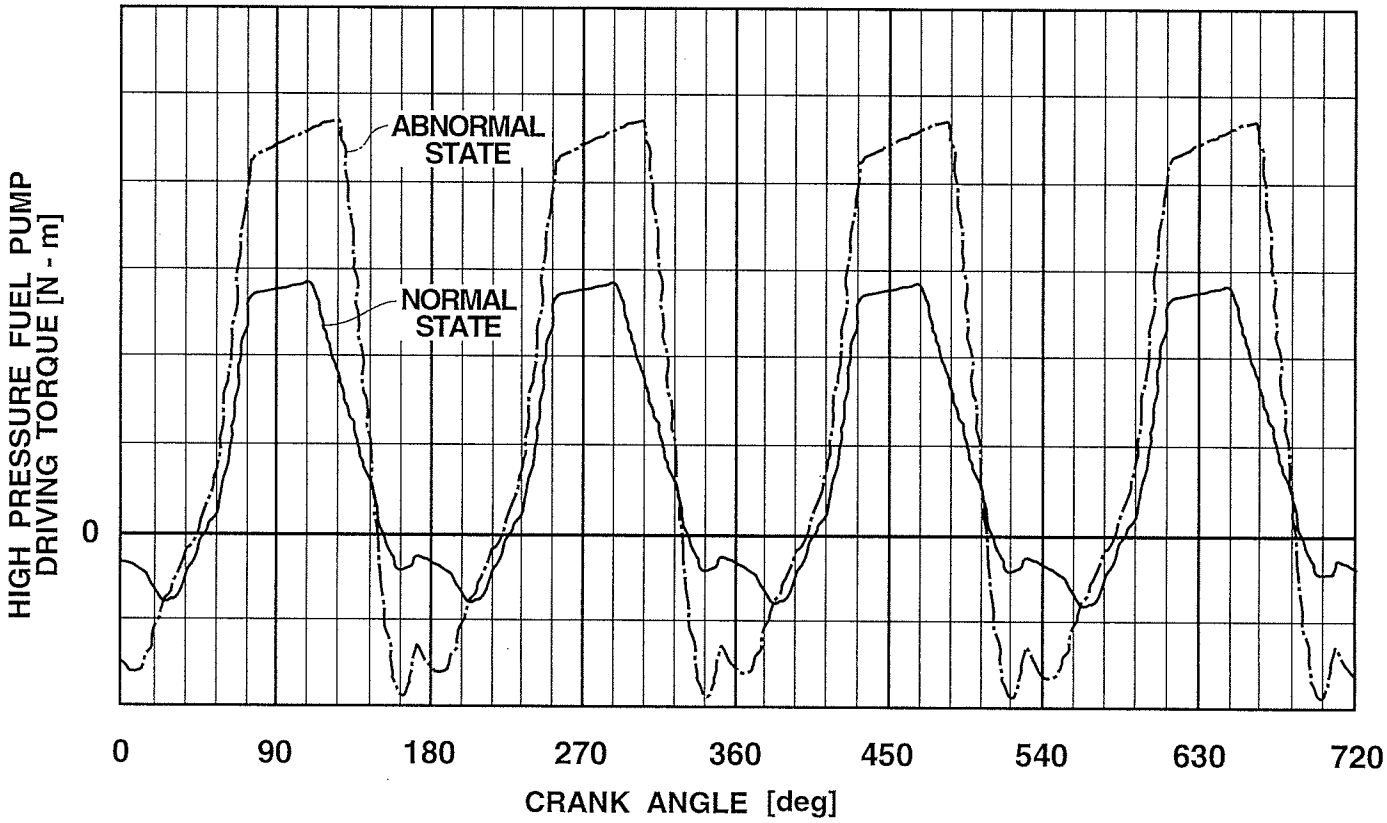
FIG. 3 is a characteristic view showing a driving torque of a high pressure fuel pump by comparing a normal state and an abnormal state.

FIG. 3 shows a driving torque of the high pressure fuel pump 46 in which the pump driving cam presses the plunger, for example, at each 180 degrees CA. A characteristic shown as "NORMAL STATE" shows a variation of the driving torque when the fuel pressure P within the common rail 45 is in the normal region. As shown in the drawing, when the pump driving cam presses the plunger, the reaction force is generated. Accordingly, the driving torque becomes high at each 180 degrees CA. Besides, in a region corresponding to the start of the increase of the cam for driving the pump, the pump driving cam is conversely urged in the rotation direction through the plunger by the hydraulic pressure within the pump chamber. With this, the driving torque becomes temporarily negative.

When the fuel pressure P within the common rail 45 (that is, within the pump chamber) is extraordinarily increased due to some abnormal state, for example, the operation malfunction of the spill valve which releases the pump chamber in the middle of the discharge process, the reaction force at the pressing of the plunger at each 180 degrees CA is increased as shown in the characteristic shown as "ABNORMAL STATE" in FIG. 3, so that the peak value of the driving torque becomes high. Moreover, conversely, in a region in which the driving torque becomes negative, the absolute value of the driving torque becomes large. Accordingly, the variation width of the tension force which is acted to the chain 43 arranged to drive the high pressure fuel pump 46 becomes large. Moreover, the peak value of that tension force becomes high. Accordingly, the adverse effect is acted to the durability of the chain 43.

In particular, in the rotation of the crank shaft 21 of the internal combustion engine 1, there is the microscopic rotation variation according to the compression stroke and the expansion stroke of the cylinders. The tension variation of the chain is also generated by this rotation variation of the crank shaft 2. Accordingly, when the peak value and the variation width of the driving torque of the high pressure fuel pump 46 is increased by the abnormal increase of the fuel pressure P within the common rail 45 as shown in FIG. 3, the both tension variations are overlapped with each other. With this, the variation width of the tension variation and the peak value of the tension may be excessively increased.

In this embodiment, the mechanical compression ratio is decreased by using the variable compression ratio mechanism 2, with respect to the above-described abnormal increase of the fuel pressure P. By this decrease of the compression ratio, the rotation variation of the crank shaft 21 according to the compression stroke and the expansion stroke of the cylinders become small. Accordingly, the tension increase of the chain 43 according to the increase of the fuel pressure P is at least partially relieved. The variation width of the tension variation becomes small. Moreover, the peak value of the tension becomes low. With this, the chain 43 is protected.

Moreover, in the above-described embodiment, it is possible to continue to drive the internal combustion engine 1, that is, to run the vehicle, while protecting the chain 43 in this way.

Besides, the desired fuel amount necessary for obtaining the same torque is increased in accordance with the decrease of the thermal efficiency due to the above-described decrease of the compression ratio. Accordingly, the supply and discharge balance of the discharge amount of the high pressure fuel pump 46 and the fuel injection amount is varied. The increase degree of the fuel pressure P within the common rail 45 in the malfunction state of the high pressure fuel pump 46 is slightly suppressed relative to a case in which the compression ratio is not decreased.

Figure 4:
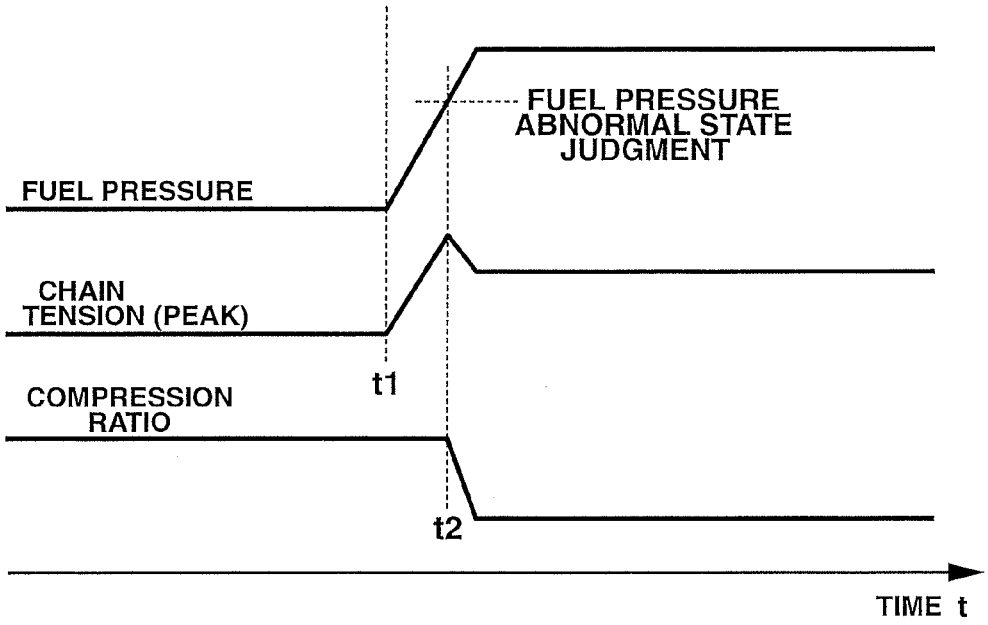
FIG. 4 is a time chart showing a variation of a compression ratio and so on in this embodiment.

Next, FIG. 4 is a time chart for illustrating an operation of the above-described embodiment. FIG. 4 shows a relationship among variations of the fuel pressure P within the common rail 45, the tension of the chain 43 (more specifically, the peak value at the instant time), and the compression ratio by the variable compression ratio mechanism 2. In the example of the drawings, the malfunction is generated in the fuel pressure control system at time t1. The fuel pressure P is gradually increased. Accordingly, the tension of the chain 43 is gradually increased. At time t2, it is judged that the fuel pressure P is extraordinarily increased at steps 3 and 4. The compression ratio becomes the minimum compression ratio $\epsilon$min. Consequently, the tension of the chain 43 (the peak value) is decreased. Simultaneously, the variation width of the tension is decreased.

Hereinabove, the one embodiment according to the present invention is illustrated. The present invention is not limited to the above-described embodiment. Various variations can be employed. For example, in the above-described embodiment, it is judged that the fuel pressure is in the abnormal state when the value of the fuel pressure P itself exceeds the upper limit fuel pressure Pmax, and when the difference $\Delta$P (that is, the deviation from the target fuel pressure tP) obtained by subtracting the target fuel pressure tP from the fuel pressure P at that time exceeds the predetermined threshold value $\Delta$Pmax. However, it may be judged that the fuel pressure is in the abnormal state when only one of the above-described two conditions is satisfied. Moreover, the only one of the above-described two conditions may be judged. Furthermore, in the above-described embodiment, the variable compression ratio mechanism 2 which is constituted by the multi-link piston crank mechanism is used. However, the present invention is similarly applicable to variable compression ratio mechanism of any types. Furthermore, the high pressure fuel pump 46 is not limited to the above-described plunger pump. The high pressure fuel pump 46 may be high pressure fuel pump of any types as long as the pump is mechanically driven through the chain 43 by the crank shaft 21. Moreover, the present invention is similarly applicable to the common rail type diesel engine.

The invention claimed is:

1. A control device for an internal combustion engine which includes a variable compression ratio mechanism arranged to vary a mechanical compression ratio, and a high pressure fuel pump arranged to supply a high pressure fuel to a common rail, and to be driven from a crank shaft through a chain, the control device comprising:

a fuel pressure abnormal state sensing section configured to sense an abnormal increase of a fuel pressure within the common rail, the control device being configured to decrease the mechanical compression ratio in the abnormal state of the fuel pressure.

2. The control device for the internal combustion engine as claimed in claim 1, wherein the fuel pressure abnormal increase is sensed based on at least one of a value of the fuel pressure within the common rail, and a difference between a target fuel pressure and an actual fuel pressure within the common rail.

3. The control device for the internal combustion engine as claimed in claim 1, wherein the high pressure fuel pump is a plunger pump arranged to be driven by a pump driving cam provided to a cam shaft of an intake valve side or a cam shaft of an exhaust valve side.

4. A control method for an internal combustion engine which includes a variable compression ratio mechanism arranged to vary a mechanical compression ratio, and a high pressure fuel pump arranged to supply a high pressure fuel to a common rail, and to be driven from a crank shaft through a chain, the control method comprising:

sensing an abnormal increase of a fuel pressure within the common rail, and decreasing the mechanical compression ratio in the abnormal state of the fuel pressure.

* * * * *